United States Patent [19]

Nilsson et al.

[11] Patent Number: 4,786,209

[45] Date of Patent: Nov. 22, 1988

[54] METHOD FOR MAINTENANCE OF VALVES INCLUDED IN A SUBSEA PRODUCTION SYSTEM FOR OIL AND GAS

[75] Inventors: Tore Nilsson; Chajkiel Pajes; Rolf J. Andersson; Kjell Höglund, all of Västerås, Sweden; Ragnar Husebye, Trondheim, Norway; Sigbjørn Hoyland, Hommersåk, Norway; Hans Lindland, Sandnes, Norway; Tore Mong, Randaberg, Norway; Erling Nesse, Straumsgrend, Norway

[73] Assignee: AB ASEA-ATOM, Västerås, Sweden

[21] Appl. No.: 111,341

[22] Filed: Oct. 22, 1987

[30] Foreign Application Priority Data

Oct. 22, 1986 [SE] Sweden ..... 8604506

[51] Int. Cl.[4] ..... B63C 11/00; F16L 1/04

[52] U.S. Cl. ..... 405/188; 166/365; 405/195; 405/169; 405/158

[58] Field of Search ..... 405/195, 168, 169, 170, 405/171, 185, 188, 190, 191, 158; 166/365, 338, 339, 341, 343, 356

[56] References Cited

U.S. PATENT DOCUMENTS

| | | | |
|---|---|---|---|
| 3,204,417 | 9/1965 | Robley | 405/170 |
| 3,451,224 | 6/1969 | Colechia et al. . | |
| 3,464,489 | 9/1969 | Thomas | 166/365 X |
| 3,708,990 | 1/1973 | Crooke . | |
| 3,851,491 | 12/1974 | Mason . | |
| 3,983,708 | 10/1976 | Houot | 405/195 |
| 4,030,309 | 6/1977 | Mason . | |
| 4,142,584 | 3/1979 | Brewer et al. | 166/365 X |
| 4,278,362 | 7/1981 | Scherrer | 166/339 X |
| 4,601,610 | 7/1986 | Campbell et al. | 405/158 X |

FOREIGN PATENT DOCUMENTS 2152556 8/1985 United Kingdom .

*Primary Examiner*—Dennis L. Taylor

*Attorney, Agent, or Firm*—Watson, Cole, Grindle & Watson

[57] ABSTRACT

The present invention relates to a method for replacing an insert unit included in an insert valve assembly belonging to a subsea production system for gas and oil. In carrying out the method, a manipulator (1) is brought by means of a sheave (2), a hoisting cable (3) and guide wires (4, 5) down to a predetermined location on the bottom of the sea. The manipulator comprises a telescopic arm (15, 16) which is then moved towards and fixed by means of a hook (20) and a lug (21) to a valve tree (17) which supports a valve (22), the insert unit (26) of which is to be unscrewed from the respective valve housing and be replaced. A carriage (18) located in the manipulator and comprising retracting, aligning and fixing devices (32, 33, 34) is brought with the aid of the telescopic arm and a rail, located on the top side of the carriage, towards the valve tree and is fixed to retraction cones (35, 36, 37) mounted on the valve tree. This allows a moment producing tool (31), mounted in the carriage, to grapple that castellated nut (24) which holds together the insert unit and valve housing of the valve. Thereafter, a releasing moment is applied on the castellated nut, whereby the castellated nut with the insert unit is unscrewed from the valve housing and the valve tree. The carriage with the insert unit is separated from the valve tree and is brought back via the telescopic arm to the manipulator. The insert unit of the valve is replaced by a new insert unit, either by a new insert unit stored in the manipulator and with the aid of gripping arms present in the manipulator, or by raising the manipulator to the surface where replacement can be carried out, whereafter the carriage is again moved towards and fixed to the valve tree. This also allows the moment producing tool to move the new insert unit with its castellated nut towards the valve housing, whereupon a tightening moment can be applied.

3 Claims, 1 Drawing Sheet

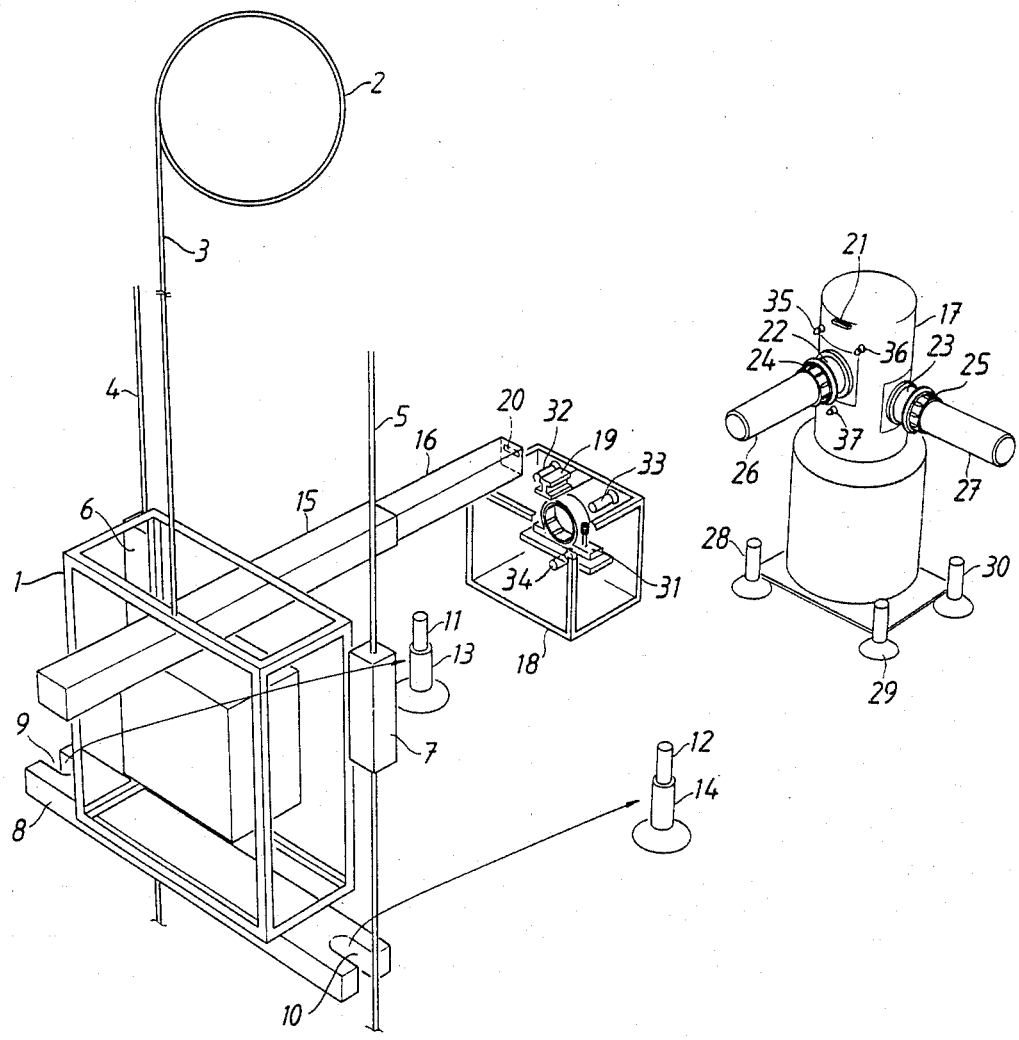
2
3
4
5
6
1
15
16
20
32
19
33
34
31
18
11
13
9
7
8
12
14
10
21
35
22
24
36
23
25
17
37
26
27
28
30
29

METHOD FOR MAINTENANCE OF VALVES INCLUDED IN A SUBSEA PRODUCTION SYSTEM FOR OIL AND GAS

TECHNICAL FIELD

The present invention relates to a method for replacement of an insert unit included in an insert valve assembly for a subsea production system for gas and oil. Such a production system is often called an SPS system, which is an abbreviation of Submerged Production Syste. In order to describe the invention in its proper context, a short description of the technical field to which the invention belongs will first be given. The technical field is described, inter alia, in STU-Information No. 118-1979, Offshore, by J. Palmér and L. Edström (issued by the National Swedish Board for Technical Development).

The hole which is drilled in the bottom of the sea for oil and gas production is built up of a number of casing pipes, which are cast to the different sediments with a predetermined distance and with decreasing hole dimensions from the surface of the sea bottom and down towards the largest depth.

On the bottom of the sea and around the opening of the casing pipe a so-called wellhead is attached, which forms the foundation of the bottom-based part of the subsea production system.

Inside the casing pipes are placed the production pipes, which are to lead the normally multi-phase fluids up to the surface. These fluids may consist of solid particles, oil, water, and gases.

On the foundation and around the production pipes there is mounted a substantially tubular structure which, among other things, supports valves connected to the production pipes. The valves are intended for flow control of the different fluids. This structure is designated valve tree (or "Christmas tree"), the reason being that the tubular structure may be conceived as a stem and the projecting valves as branches.

On the foundation and around the valve tree there is placed the remaining underwater based production equipment, which together forms a production tree. This consists, among other things, of guide posts with guide wires for guiding and positioning peripheral equipment of various kinds. The peripheral equipment comprises operating, control and auxiliary equipment for valves, safety systems of different kinds, etc.

BACKGROUND ART

It is, of course, very important that the valves which are used for controlling the various production flows should be intact. However, the valves operate under difficult conditions, both as far as the actual fluids are concerned and as far as the surroundings are concerned. To ensure satisfactory operation, the valves have to be capable of being repaired, and, possibly, non-operating parts of the valves have to be capable of being replaced. Normally, therefore, the valves are designed so as to have their vital parts built into a replaceable insert unit. Upon replacement, the existing non-operating insert unit must first be removed from its valve housing, whereafter a new insert unit is mounted into the valve housing. To ensure satisfactory sealing between the valve housing and the insert unit, relatively high tightening moments are applied to the nut—normally a castellated nut—which holds the valve housing and the insert unit together. When detaching the insert unit, a releasing moment of at least the same magnitude is normally required.

Since a valve tree comprises a plurality of valves whose insert units may need to be replaced, the tool that is to bring about the releasing and the tightening, respectively, of the castellated nut must be capable of being positioned against the valve in question. It is also desirable for this part of the replacement process to be carried out by means of remote operation.

An example of a device for positioning a tool for replacement of insert units is given in the above-mentioned STU publication. The oil company Exxon has in its SPS system a manipulator which is capable of being moved on a rail system secured to the surrounding steel structure of the wellhead. The movement around in the production tree and the associated pipe system takes place by means of a rack. The positioning is remote-controlled and takes place, among other things, by means of TV and video cameras.

Secured to and built into the manipulator are moment producing devices intended for releasing and tightening, respectively, the castellated nut which fixes the insert unit of the valve to the valve housing, as well as for threading in and out the insert unit. The reason for having different moment producing devices for effecting the releasing and the tightening moment, respectively, and for effecting the moment for threading the nut in and out is that the difference between the magnitude of the two moments required is considerable. The high releasing and tightening moment in the Exxon design, which is generated in the above-mentioned manipulator, is brought about by allowing two hydraulically operated piston rods to act against two projections on a rotatable ring which is in engagement with and which surrounds the castellated nut. In the Exxon manipulator, the moment for threading the nut in and out is brought about with the aid of a worm gear which engages external splines on the rotatable ring mentioned.

The problems with the Exxon design and similar designs are manifold. The manipulator including the moment producing devices as well as devices for positioning consist of large and unwieldy structures which may have a weight of some twenty or thirty tons or more. The high weight necessitates that the manipulator is bottom-based and that transportation must take place on some form of rail system. Also the associated rack structure for transportation will therefore require heavy dimensions, the power requirement for the positioning being correspondingly high. Moment producing devices for releasing and tightening, respectively, of the castellated valve nut also have a limited possibility of rotary motions. The fact that two different moment producing devices are needed to release the insert unit must also be considered a less successful solution.

Therefore, for a long time there has been a need of light and easily manageable constructions, improved moment producing devices, etc., to facilitate the process when replacing an insert unit in valves used in SPS systems for oil and gas production.

DISCLOSURE OF THE INVENTION

The method when replacing insert units in valves used for oil and gas recovery in accordance with the invention comprises a sequence of operations which presupposes that certain mechnical devices are available. Some of these are part and parcel of the general store of mechanical constructions.

The invention is based on the use of a modified version of a manipulator produced by Deep Ocean Technology Inc., U.S.A., disclosed, inter alia, in its pamphlet "BANDIT", revised October 1984, and in ASEA's pamphlet "The Bandit—a Working Machine for Drilling Support". This is a lightweight manipulator and therefore need not be stationed on the bottom of the sea. By means of a hoisting cable tethered to the manipulator, the manipulator can be lowered to the bottom of the sea and be lifted up to the surface. By means of guide wires secured to the bottom, which serve as guidelines, the manipulator is guided with the aid of guide frames, mounted on the manipulator, towards a pre-determined location on the wellhead when the manipulator is lowered down. At this predetermined location at least two guide posts are to be arranged, which may be guide posts especially intended for the manipulator or which may be guide posts otherwise included in the production tree.

For a method according to the invention, the manipulator is to be mounted on a beam which, at either end, has guide slots to surround those guide posts against which they are moved by the guide wires.

Built into the manipulator is a carriage which, among other things, supports the tool—a nut tightener—which is used for releasing and tightening the castellated valve nut. The manipulator with carriage, tool, etc. is now to be positioned, on the basis of the guide posts used, in such a way that the tool—both laterally and vertically—is positioned approximately straight in front of and opposite to the valve that is to be replaced. This can be done by a suitable lateral mounting of the manipulator on the above-mentioned beam, and by placing spacing sleeves on the guide posts so as to obtain an approximately correct height above the wellhead.

The manipulator also has mounted on it a remotely operable telescopic arm. After the manipulator has been approximately correctly placed according to the method described, the telescopic arm is moved against and fixed by means of a hook on the arm to a lug on the valve tree. This causes the telescopic arm to become loadable. The above-mentioned carriage with the tool for applying a moment on the castellated valve nut is now moved on the telescopic arm towards the valve in question.

In order for the tool to be able to grapple the castellated valve, an accurate positioning of the tool is required. In addition to the moment producing tool, the car also contains two or more devices for exact positioning, alignment, and fixing of the tool. A suitable device for carrying out these operations is disclosed in Swedish patent application No. 8604505-1 ("Retracting, aligning and fixing device").

A device according to the above may consist of a mechanism with two or more symmetrical fingers with hook-shaped ends, which mechanism is attached to a sleeve which is urged by a motor-driven screw, the hooks of the fingers being guided towards an inner and an outer funnel. Upon movement of the fingers towards the valve tree, the fingers open so as to create a sufficient gap to close around a retraction cone mounted on the valve tree. By turning the finger movement from the valve tree, first a substantially radial movement of the finger mechanism is obtained for closing around the retraction cone. Thereafter, a substantially axial movement is obtained, whereby the inner funnel is drawn towards the cone, which, after additional movement, is urged towards the innermost part of the funnel. This results in a precise positioning and fixing of the alignment devices and of the moment producing tool fixed to these devices.

Since the tool for applying a moment on the castellated valve nut is now correctly positioned, this part of the replacement procedure can now commence. A suitable tool for carrying out the replacement procedure may consist of a ring rotatable in a bearing housing, the ring having internal splines for engaging the splines of the castellated nut and having external splines for engaging diametrically positioned drive devices for the rotary motion. Since this tool is fixed to the valve tree by means of the alignment device, the telescopic arm will not be loaded with any mechanical stresses in connection with the release or tightening of the castellated nut.

After the insert unit with the castellated nut has been detached from the valve housing, the alignment devices are opened, and the carriage with the tool, the alignment devices and the detached insert unit is guided on the telescopic arm, resting on the lug, out to the manipulator.

The further replacement procedure may comprise lifting the manipulator towards the surface for removing a non-operating insert unit and attaching a new insert unit in the tool. Alternatively, an operational insert unit may be stored in the manipulator and be placed in the tool with the aid of gripping arms included in the manipulator.

The method for mounting the new insert unit in position comprises the same steps as have already been described with reference to the telescopic arm, the movement of the carriage, the alignment and fixing of the tool, the development of moments, etc.

BRIEF DESCRIPTION OF THE DRAWING

The method for replacing an insert unit will now be described with reference to the accompanying drawing, the single figure of which shows a valve tree 17 having mounted thereon two insert valve assemblies 22 and 23 with respective castellated nuts 24 and 25, as well as insert units 26 and 27. The figure further shows a manipulator 1 with a telescopic arm 15, 16, a carriage with retracting, aligning and fixing devices 32, 33 and 34, as well as a moment producing tool 31.

The different parts shown in the drawing will be described in more detail below.

DESCRIPTION OF THE INVENTION

The fundamental construction of the manipulator 1 on which the invention is based is clear from the accompanying figure. It consists of a parallelepipedic frame structure and is raisable and lowerable by means of a surface-based sheave 2 and a hoisting cable 3, attached to the upper part of the manipulator 1. Via guide wires 4 and 5, acting as guidelines running in respective guide frames 6 and 7 attached to the manipulator 1, the manipulator 1 is guided, depending on which valve to be repaired, towards a predetermined position on the wellhead.

The manipulator 1 is fixedly mounted on a beam 8 having guide slots 9 and 10 for receiving the guide posts 11 and 12. The manipulator 1 can be positioned vertically by means of spacing sleeves 13 and 14 on the guide posts 11 and 12 and laterally by lateral displacement prior to being fixed on the beam 8.

The manipulator 1 comprises a remotely operated telescopic arm 15 and 16 capable of being brought towards a valve tree 17. Displaceably mounted on the telescopic arm 15, 16 is a carriage 18 which, in order to provide a clearer view, is shown detached from the arm. The suspension and guiding device of the carriage 18 in the telescopic arm 15, 16 consists of the rail 19 placed on the top side of the carriage 18.

As mentioned under the DISCLOSURE OF THE INVENTION, the telescopic arm 15, 16, with the carriage 18 still mounted in the manipulator 1, is brought towards the valve tree 17. The position of the manipulator 1 at the predetermined location, in relation to the valve in question, now allows a hook 20 at the tip of the telescopic arm 15, 16 to be brought to engage a lug 21 on the valve tree 17.

In the example shown in the figure, the valve tree 17 supports at least two valves 22 and 23 with castellated nuts 24 and 25 and replaceable insert units 26 and 27. The valve tree 17 is fixedly mounted on the wellhead, which is also the case with four guide posts belonging to the SPS system. The figure shows three of the guide posts 28, 29 and 30. These guide posts, in the embodiments shown, may replace the guide posts 11 and 12.

When the hook 20 of the telescopic arm 15, 16 has been brought into engagement with the lug 21 on the valve tree 17, the carriage 18 may be brought, via slots in the arm and the rail on the upper side of the carriage, from the manipulator 1 and towards the valve tree 17. As will also have been clear from the above disclosure of the principle of the invention, the carriage 18 includes devices for aligning, retracting and fixing the carriage 18 as well as a tool 31 for releasing and tightening, respectively, and for threading in and out, respectively, the castellated nut of the valve.

As will have been clear from the above, the positioning devices are formed so as to have a retracting and a fixing function. In the example shown in the figure, the carriage 18 includes three such devices, shown at 32, 33 and 34. On the valve tree 17 the corresponding retraction cones 35, 36 and 37 are positioned. The location of the lug 21 and these cones in relation to the valve 22 is such that when the telescopic arm 15, 16 and the carriage 18 with their respective opposite attachment devices have been brought into engagement, the moment producing tool 31 mounted in the carriage 18 has the correct position to enable it to grapple the castellated valve nut. Once the cones 35, 36 and 37 have firmly engaged, the load on the telescopic arm 15, 16 via the hook 20 and lug 21 ceases. Corresponding lugs and guide cones exist for all the valves on the valve tree (however, not shown for valve 23).

By remote control, the moment-applying tool is then brought into engagement with the castellated valve nut, whereupon a remotecontrolled moment for releasing and threading out the nut is applied. This enables the insert unit of the valve to be unscrewed and be replaced.

We claim:

1. A method for replacing an insert unit (26) included in an insert valve assembly (22) belonging to a subsea production system for oil and gas using a manipulator (1) which by means of a hoisting cable (3) can be raised and lowered to the desired depth, by means of guide wires (4, 5), acting as guidelines passing through guide frames (6, 7) fixed to the manipulator, can be positioned at the desired location on the bottom of the sea, is mounted on a beam (8) with guide slots (9, 10), said guide slots being intended to receive guide posts (11, 12), which are placed on the bottom of the sea and which are provided with spacing sleeves (13, 14) to obtain the proper height above the bottom of the sea for the manipulator, has a built-in remotely operable telescopic arm (15, 16) provided with a hook (20) at the end of the arm, has a built-in carriage (18) movable on the telescopic arm, said carriage comprising a moment-producing tool (31) as well as aligning, retracting and fixing devices (32, 33, 34) for said carriage and said tool, and that the insert valve assembly with its insert unit is mounted on a valve tree (17) which has a lug (21) for receiving the hook of the telescopic arm, and has guide cones (35, 36, 37) for aligning, retracting and fixing devices mounted on the carriage, said insert unit comprising a nut (24) by which the insert unit is screwed to and unscrewed from, respectively, the rest of the insert valve assembly, and that the moment-producing tool is formed so as to engage and grapple the nut of the insert unit, said method comprising the sequential steps of lowering the manipulator down towards the bottom of the sea by means of the hoisting cable and guide wires and positioning via the beam, the guide slots, the guide posts and the spacing sleeves so that the tool present in the carriage arrives in front of that insert valve assembly whose insert unit is to be replaced, bringing the telescopic arm of the manipulator towards the valve tree so that the hook of the arm is secured to the lug on the valve tree, moving the carriage towards the valve tree, maneuvering the aligning, retracting and fixing devices in the carriage into engagement with the respective retraction cones on the valve tree, guiding the moment-producing tool towards the insert valve assembly so as to engage and grapple the nut of the insert unit, applying a releasing moment on the nut of the insert unit via the moment-producing tool, applying a moment for threading the insert unit out of the rest of the insert valve assembly via the moment-producing tool, detaching the aligning, retracting and fixing devices in the carriage from their respective retraction cones on the valve tree, moving the carriage with the insert unit back to the manipulator, replacing the disengaged insert unit by a new insert unit, moving the carriage with the insert unit towards the valve tree, maneuvering the aligning, retracting and fixing devices in the carriage into engagement with the respective retraction cones on the valve tree, maneuvering the moment-producing tool towards the remaining part of the insert valve assembly, the new insert unit being inserted into said part, applying a moment on the nut of the insert unit for threading in the insert unit via the moment-producing tool, applying a fastening moment on the nut of the insert unit via the moment-producing tool, withdrawing the moment-producing tool from the nut of the insert unit, detaching the aligning, retracting and fixing devices in the carriage from their respective retraction cones on the valve tree, moving the carriage back to the manipulator, disengaging the hook on the telescopic arm from the lug on the valve tree, moving the telescopic arm back to the manipulator, and raising the manipulator to the surface of the sea by means of the hoisting cable and the guide wires.

2. Method according to claim 1, characterized in that replacement of the disengaged insert unit by a new insert unit takes place by the steps of raising the manipulator to the surface of the sea by means of the hoisting cable and the guide wires, replacing the disengaged insert unit by a new insert unit, and lowering the manipulator with the aid of the hoisting cable and the guide wires towards the bottom of the sea and positioning it in front of the insert valve assembly to be replaced.

3. Method according to claim 1 and assuming that the manipulator is provided with maneuverable gripping arms and at least one operational insert unit, wherein replacement of the disengaged insert unit by a new insert unit is carried out with the aid of the gripping arm as follows:

detaching the disengaged insert unit from the moment-producing tool, and inserting a new insert unit into the moment-producing tool.

* * * * *